US011472005B2

(12) United States Patent
Wang

(10) Patent No.: US 11,472,005 B2
(45) Date of Patent: Oct. 18, 2022

(54) CLAMP HEAD ADAPTER

(71) Applicant: Henry Wang, Winter Springs, FL (US)

(72) Inventor: Henry Wang, Winter Springs, FL (US)

( * ) Notice: Subject to any disclaimer, the term of this patent is extended or adjusted under 35 U.S.C. 154(b) by 234 days.

(21) Appl. No.: 16/707,562

(22) Filed: Dec. 9, 2019

(65) Prior Publication Data

US 2021/0170549 A1 Jun. 10, 2021

(51) Int. Cl.
*B25B 5/16* (2006.01)
*B25B 5/06* (2006.01)

(52) U.S. Cl.
CPC ..... *B25B 5/163* (2013.01); *B25B 5/068* (2013.01)

(58) Field of Classification Search
CPC ..... B25B 5/163; B25B 5/102; B25B 5/003; B25B 5/006; B25B 5/147; B25B 5/101; B25B 5/166; B25B 1/103; B25B 5/068; F16B 2/065
USPC ..... 269/902, 268, 246, 249, 272, 283, 309, 269/43; 33/573; D8/395
See application file for complete search history.

(56) References Cited

U.S. PATENT DOCUMENTS 363,041 A * 5/1887 Baker ..... B25B 1/125 269/140
2,485,876 A 6/1945 Guest
2,519,107 A 8/1950 Brown
2,666,352 A 1/1954 Philips
2,796,787 A 4/1955 Aske
2,894,548 A 1/1956 Peck
2,766,649 A 10/1956 Labry, Jr.
2,918,172 A 8/1960 Sloboda
3,322,423 A 6/1964 Popow
3,768,797 A * 10/1973 Kartasuk ..... B25B 1/2452 269/283
4,121,815 A * 10/1978 Paterson ..... B25B 5/102 269/203
4,747,588 A * 5/1988 Dillhoff ..... B25B 5/12 269/258
5,135,209 A * 8/1992 Penny ..... B25B 5/101 269/249
D340,851 S 11/1993 Sorensen
5,971,378 A 10/1999 Sweeney
6,029,964 A 2/2000 Bohl
6,367,787 B1 4/2002 Poole et al.
(Continued)

OTHER PUBLICATIONS

Microjig Matchfit X-Pad Manual (Year: 2022).*
PCT/US20/063256 International Search Report and Written Opinion, dated Apr. 6, 2021, 13 pages.

*Primary Examiner* — Mahdi H Nejad
(74) *Attorney, Agent, or Firm* — Wolter Van Dyke Davis, PLLC; Robert L. Wolter

(57) ABSTRACT

A clamp head adapter (100), including: an adapter body (102); a slot (104) disposed on a first side (106) of the adapter body and configured to receive and secure therein a clamp head (24); and a groove (110) recessed into a body surface (112) of the adapter body opposite the first side. The groove includes a vertex (130); a first bevel angle (132) between a normal line (134) normal to the body surface and a first line (136) between the vertex and a first corner (138) of the groove, and a second bevel angle (150) between the normal line and a second line (152) between the vertex and a second corner (154) of the groove. The first bevel angle and the second bevel angle together form a groove angle (156) that is less than 90 degrees.

21 Claims, 14 Drawing Sheets

(56) References Cited

U.S. PATENT DOCUMENTS

| | | | | |
|---|---|---|---|---|
| 6,431,534 | B1 * | 8/2002 | Orosz | B25B 5/101 269/249 |
| 6,698,071 | B1 * | 3/2004 | Greer, Jr. | F16B 2/10 24/522 |
| 7,254,895 | B1 * | 8/2007 | O'Donnell | B25B 5/04 248/231.51 |
| D740,639 | S | 10/2015 | Wang | |
| 10,307,894 | B1 * | 6/2019 | Wong | B25B 5/163 |
| D870,547 | S * | 12/2019 | Liao | D8/394 |
| 2004/0232608 | A1 * | 11/2004 | Wong | B25B 5/103 269/249 |
| 2006/0091598 | A1 | 5/2006 | Wong | |
| 2006/0208407 | A1 * | 9/2006 | Wang | B25B 5/06 269/6 |
| 2014/0165340 | A1 * | 6/2014 | Chuang | F16B 2/12 24/486 |
| 2016/0023330 | A1 * | 1/2016 | Chuang | B25B 5/16 269/246 |
| 2017/0355066 | A1 * | 12/2017 | Li | B25B 7/14 |
| 2018/0036867 | A1 * | 2/2018 | Wang | B25B 5/163 |
| 2018/0099404 | A1 * | 4/2018 | Wang | B25H 1/08 |
| 2021/0086328 | A1 * | 3/2021 | Barraco | B25B 1/241 |
| 2021/0299768 | A1 * | 9/2021 | Wang | B25H 1/08 |

* cited by examiner

CLAMP HEAD ADAPTER

FIELD OF THE INVENTION

The invention relates to an adapter used with a swiveled clamp head to clamp workpieces together in a direction transverse to the clamp direction.

BACKGROUND OF THE INVENTION

With respect to woodworking apparatuses such as cutting devices (i.e., table saws, routers and band saws), clamps may be used to secure workpieces directly to worktable tops. Conventionally, clamps that work in conjunction with a tabletop will clamp in a direction normal to the upper surface of the table top, thereby clamping the workpiece down to the table (or onto another workpiece disposed on the table etc.) An example clamp of this type is an F-type clamp.

A first prior art F-type clamp 10 and an identical second prior art F-type clamp 10, are illustrated in FIG. 1. Each clamp 10 includes a first post 14, a second post 16 disposed at a lower end of the first post 14, a guide arm 18 that is free to move vertically along the first post 14, a threaded shaft 20 at a distal end of the guide arm 18, a handle 22 at a top of the threaded shaft 20, and a swivel clamp head 24 at a bottom of the threaded shaft 20. The second post 16 fits into a slot 30 in a tabletop 32. The second post 16 is characterized by a shape that is complementary to a shape of the slot 30 such that the two cooperate to permit the second post 16 to move longitudinally in the slot 30 but not laterally and not out of the slot in a normal direction 36 that is normal to a surface 38 of the table top 32. Hence, the clamp 10 can be moved side to side, but is otherwise restricted by the cooperation of the slot 30 and the second post 16. In an embodiment, slot 30 has a dovetail shape, and the second post 16 has a cooperating dovetail shape.

Each clamp 10 can secure a respective workpiece (not shown) between the swivel clamp head 24 and the surface 38 of the tabletop 32. The clamps 10 clamp in a clamp direction 40 that is essentially parallel to the normal direction 36. The clamp direction 40 may deviate from the normal direction 36 slightly due to flex of the first post 14, the second post 16, the guide arm 18, and/or a loose fit between the second post 16 and the slot 30 in response to clamping force. However, the majority of the clamping force seen by the workpiece is normal to the surface 38. Consequently, when two workpieces are to be clamped together side-by-side on the worktable 32, since the majority of the clamping force is normal to the surface 38, friction is essentially the only force holding the parts to each other.

Certain procedures require relatively high side-to-side (e.g. lateral) holding forces so that the workpieces do not move relative to each other. To achieve these relatively high forces, the clamps may be tightened enough that the surface of the workpiece is damaged, or the clamp is stressed. In certain instances, the F-type clamp simply cannot be tightened enough to provide the normal clamping force necessary to achieve the required lateral clamping force. Other clamp configurations have been devised to address this. For example, a separate linear clamp oriented horizontally may be applied to the workpieces. However, in such an arrangement the workpieces may lift off the worktable 32. A stable clamping arrangement may then require several clamps at various orientations and locations. Consequently, there is room in the art for improvement.

BRIEF DESCRIPTION OF THE DRAWINGS

The invention is explained in the following description in view of the drawings that show.

DETAILED DESCRIPTION OF THE INVENTION

The Inventor has devised a clamp head adapter that can be placed on a swivel clamp head of a clamp used to clamp a workpiece to a worktable. The innovative clamp head adapter enables the lone clamp to provide not only a normal clamping force to the workpiece, but also a lateral clamping force. The normal clamping force clamps the workpiece to the worktable and the lateral clamping force can be used to clamp the workpiece laterally to one or more additional workpieces. This reduces the number of clamps necessary to perform many operations on the workpieces, thereby simplifying and speeding the process.

Figure 2:
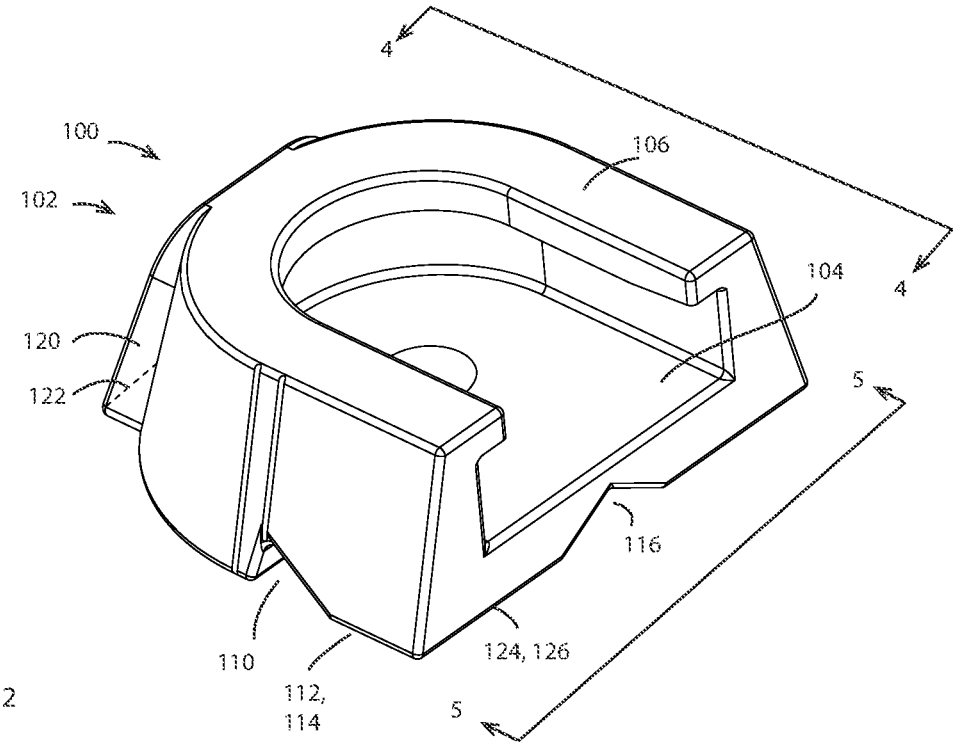
FIG. 2 is a perspective view of an embodiment of the clamp head adapter.

FIG. 2 is a perspective view of an embodiment of the clamp head adapter 100, including an adapter body 102, and a slot 104 disposed on a first side 106 of the adapter body. In an embodiment, the adapter body 102 is composed of a resilient material. Example materials include rubbers and plastics. In an embodiment, the adapter body 102 is monolithic. The adapter body 102 may be cast in a single operation or formed via an additive manufacturing process or the like. The slot 104 is configured to receive and secure therein a clamp head (not shown). For example, a swivel clamp head of a linear clamp such as an F-type clamp. An example F-type clamp with a swivel clamp head is a Micro Jig® Matchfit Dovetail Clamp®. The clamp head adapter 100 further includes a groove 110 recessed into a body surface 112 of a second side 114 of the adapter body 102 opposite the first side 106. The clamp head adapter 100 further includes a second groove 116 in the body surface 112 and disposed transverse to the groove 110. In an embodiment, the second groove 116 is disposed perpendicular to the groove 110. The clamp head adapter 100 also includes a pad 120 having a straight pad edge 122 and an opposite corner 124 having a straight corner edge 126.

Figure 1:
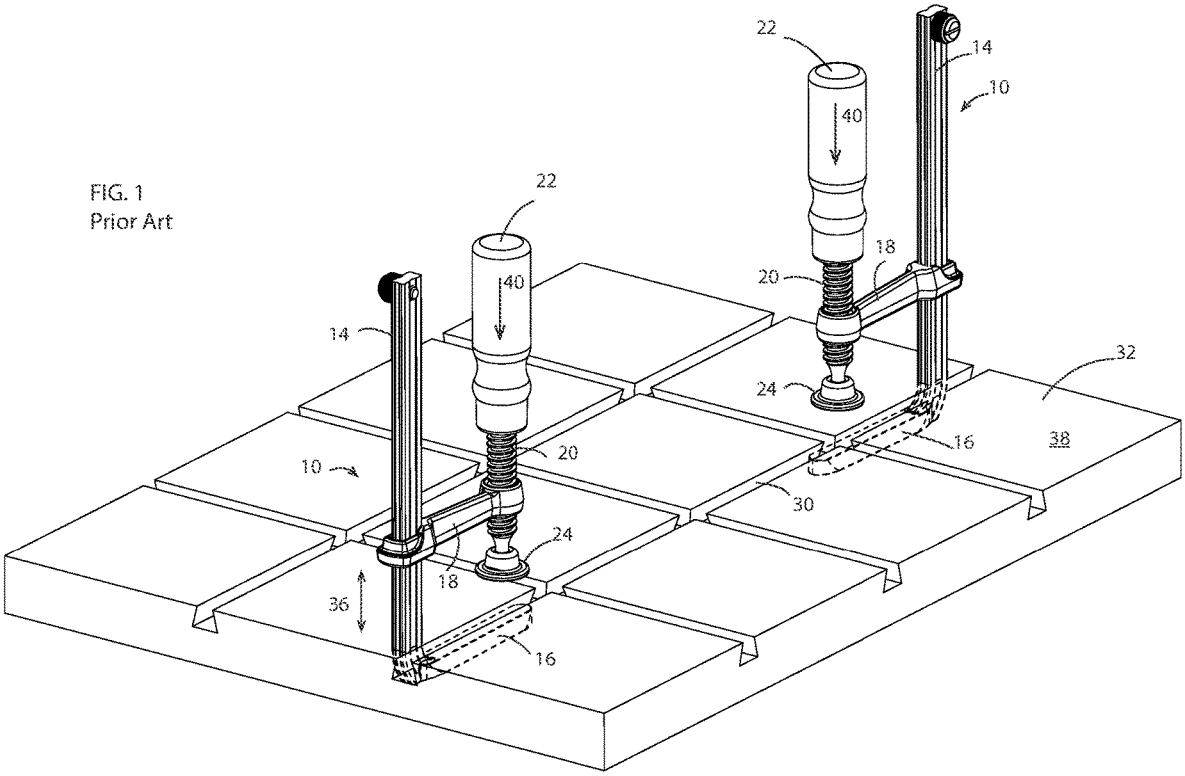
FIG. 1 Prior Art
FIG. 1 is a perspective view of two identical prior art F-type clamps installed on a worktable.
Figure 3:
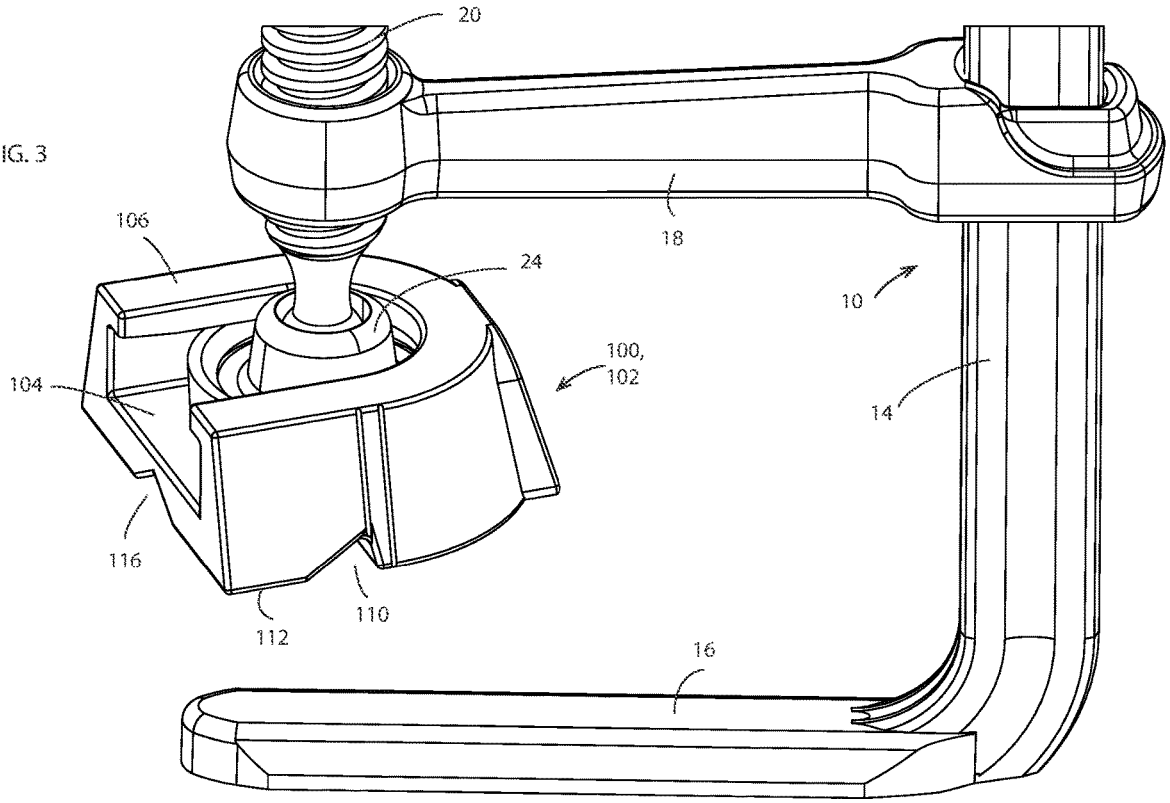
FIG. 3 is a perspective view of the clamp head adapter of FIG. 2 installed on a swivel clamp head of the F-type clamp of FIG. 1.

FIG. 3 is a perspective view of the clamp head adapter 100 of FIG. 2 installed on a swivel clamp head 24 of the F-type clamp 10 of FIG. 1. To install the clamp head adapter 100, the swivel clamp head 24 is placed at the end of the slot 104 and the clamp head adapter 100 is slid laterally onto the swivel clamp head 24 until fully seated. The clamp 10 with the clamp head adapter 100 installed can be used in the conventional manner to apply only the normal clamping force, or as disclosed below to apply both the normal clamping force and the lateral clamping force.

Figure 4:
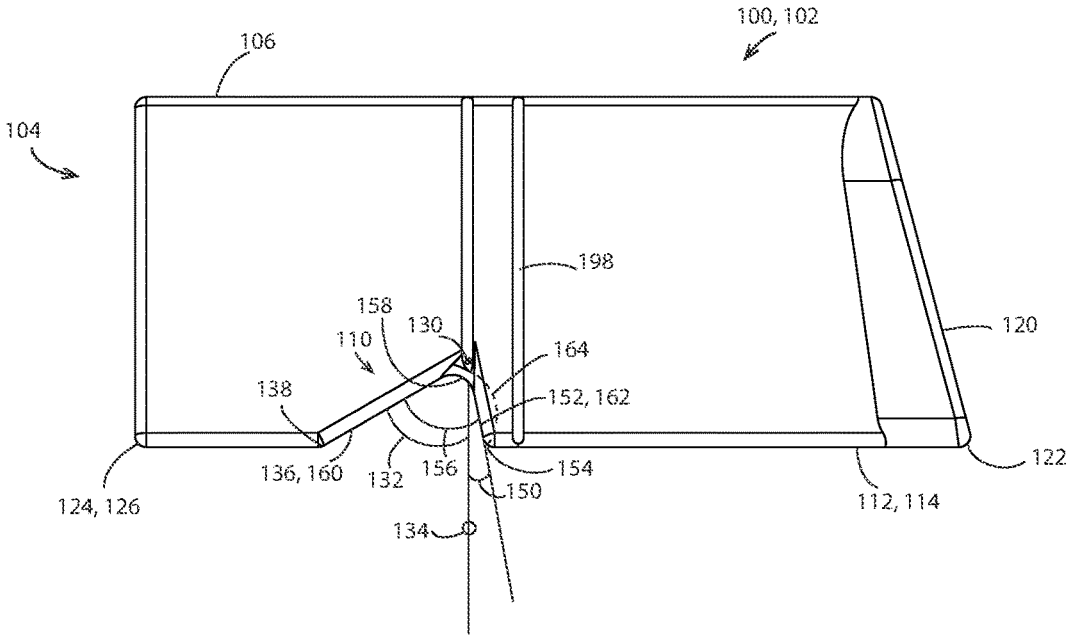
FIG. 4 is a side view of the clamp head adapter of FIG. 2 along line 4-4.
Figure 5:
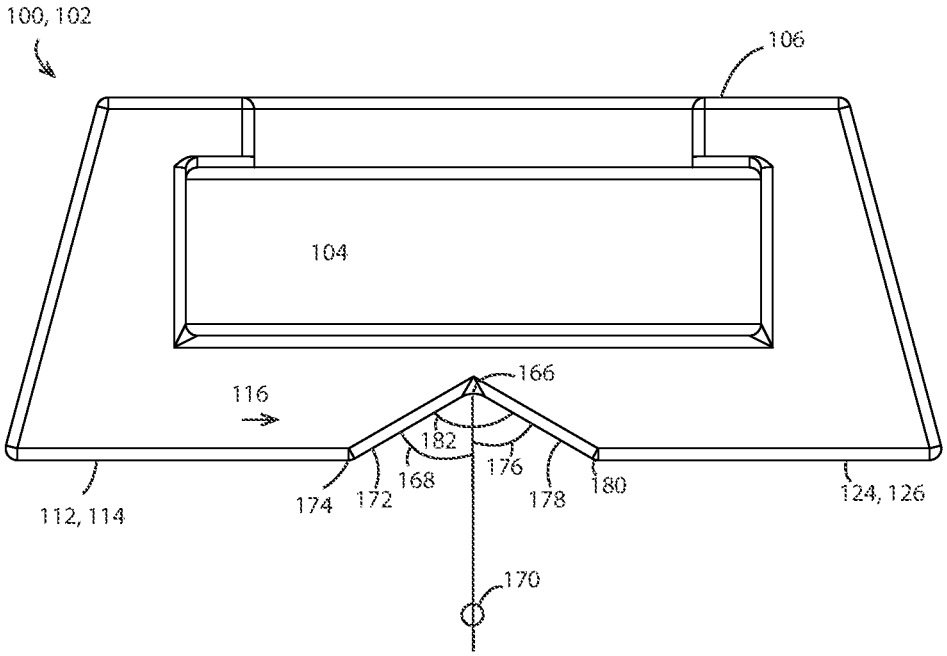
FIG. 5 is a rear view of the clamp head adapter of FIG. 2 along line 5-5.

As can be seen in FIG. 4, the groove 110 includes a vertex 130, a first bevel angle 132 between a normal line 134 normal to the body surface 112 and a first line 136 between the vertex 130 and a first corner 138 of the groove 110. The groove 110 further includes a second bevel angle 150 between the normal line 134 and a second line 152 between the vertex 130 and a second corner 154 of the groove. In an embodiment, the first bevel angle 132 and the second bevel angle 150 together form a groove angle 156. In an embodiment, the groove angle is less than 90 degrees. As seen in FIG. 4, vertex 130 is where first line 136 and second line 152 intersect. In embodiments where a stress-relieving rounded fillet 158 exists in the groove 110, the vertex 130 may be theoretical and disposed in the adapter body 102. In an example embodiment, a first indicator line 198 is present.

In an embodiment, a first side 160 of the groove 110 extends from the vertex 130 to the first corner 138 and includes a straight portion. However, the first side 160 need not be straight but could be concave instead. In an embodiment, the first bevel angle 132 is sixty (60) degrees. Other angles are acceptable so long as they are in accord with the teachings disclosed herein. In an embodiment, a second side 162 of the groove extends from the vertex 130 to the second corner 154 and includes a straight portion.

In an embodiment, the groove 110 is asymmetric, meaning that the first bevel angle 132 does not equal the second bevel angle 150. In various embodiments, the second bevel angle 150 will be less than the first bevel angle 132. In an embodiment, the second bevel angle 150 is less than forty-five (45) degrees. In an embodiment, the second bevel angle 150 is less than thirty (30) degrees. In an embodiment, the first bevel angle is sixty (60) degrees, the second bevel angle 150 is twelve (12) degrees, and the resulting groove angle 156 is seventy-two (72) degrees. In an alternate embodiment, the second side 164 (shown as a dashed line) of the groove 110 extends from the vertex 130 to the second corner 154 and is concave.

The second groove 116 includes a vertex 166, a first bevel angle 168 between a normal line 170 normal to the body surface 112 and a first side 172 between the vertex 166 and a first corner 174 of the second groove 116. The second groove 116 further includes a second bevel angle 176 between the normal line 170 and a second side 178 between the vertex 166 and a second corner 180 of the second groove 116. The first bevel angle 168 and the second bevel angle 176 form the second groove angle 182. In an embodiment, the second groove 116 is symmetric, meaning that the first bevel angle 168 and the second bevel angle 176 are equal. In an embodiment, the second groove angle 182 is one hundred twenty (120) degrees. Other groove angles known to the Artisan are possible. Moreover, the second groove angle 182 may be asymmetric in accord with the teachings related to the groove angle 156. When both the groove 110 and the second groove 116 are asymmetric, they may be the same or different from each other. The second groove 116 may be oriented transverse to the groove 110 at any angle, including perpendicular.

Figure 6:
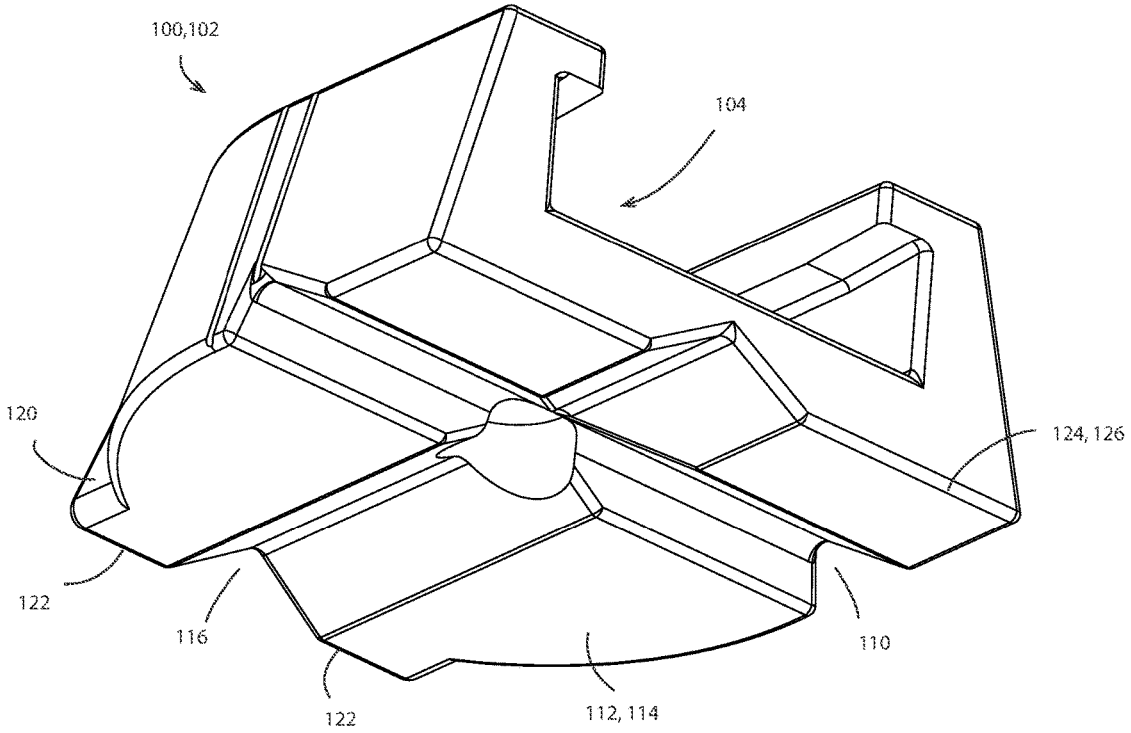
FIG. 6 is a perspective view of the clamp head adapter of FIG. 2 from below.
Figure 7:
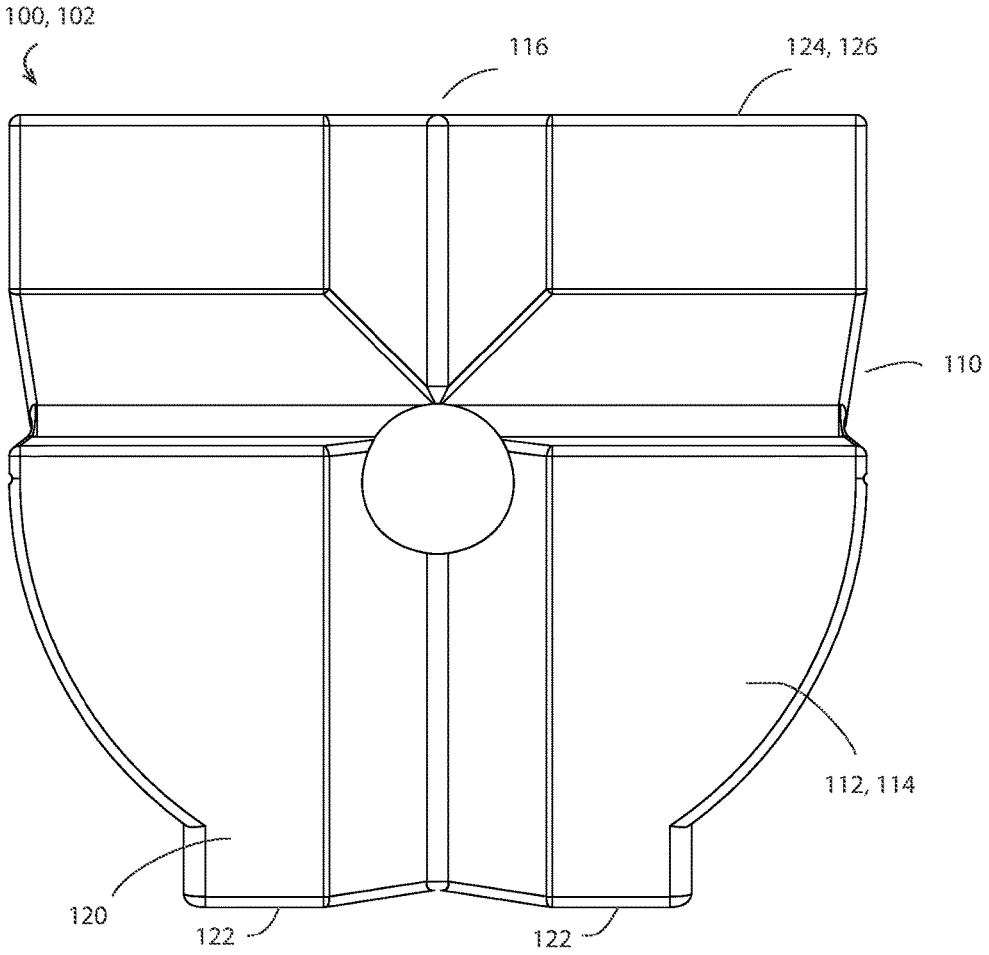
FIG. 7 is a bottom view of the clamp head adapter of FIG. 2.

FIG. 6 is a perspective view of the clamp head adapter 100 of FIG. 2 from below, showing the groove 110 and the second groove 116 disposed perpendicular to the groove 110. FIG. 7 is a bottom view of the clamp head adapter 100 of FIG. 2, also showing the groove 110 and the second groove 116. The straight pad edge 122 of the pad 120 is best visible in FIGS. 6-7. The straight pad edge 122 is interrupted by the second groove 116, but the separate parts align to form a straight line. Likewise, the straight corner edge 126 is interrupted by the second groove 116, but the separate parts align to form a straight line. In an embodiment, the straight pad edge 122 and the straight corner edge 126 are parallel to each other. Accordingly, the straight pad edge 122 and the straight corner edge 126 are on opposite ends of the clamp head adapter 100 on the second side 114.

Figure 8B:
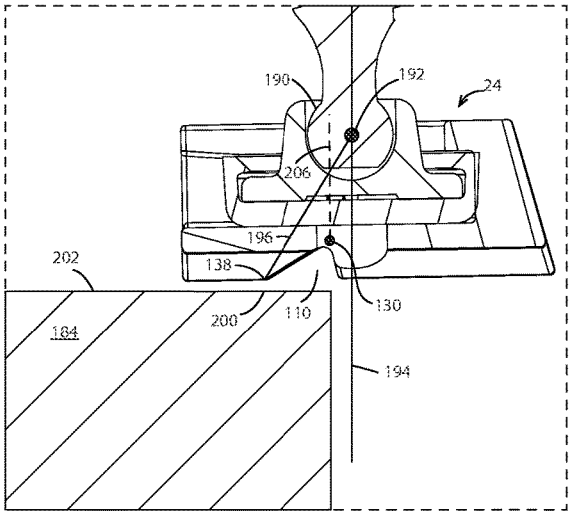
FIG. 8B is a cross section of the dashed box indicated in FIG. 8A.
Figure 8A:
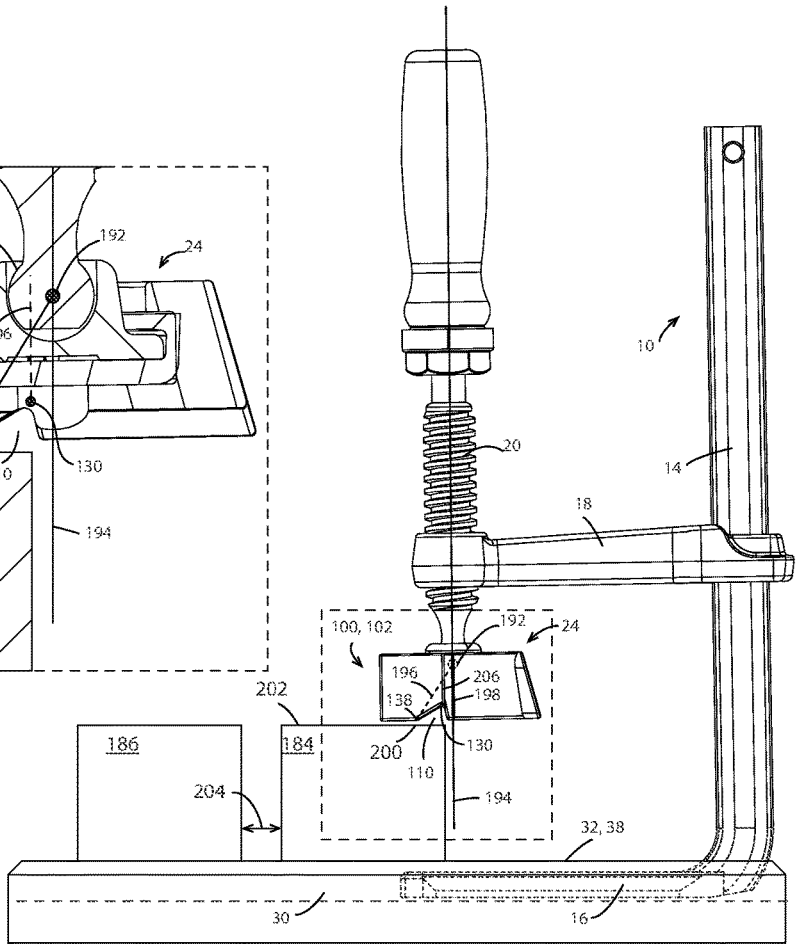
FIG. 8A is a schematic illustration of the clamp head adapter on an F-type clamp prior to clamping two workpieces together.

FIG. 8A is a schematic illustration of the clamp head adapter 100 on an F-type clamp 10 prior to clamping a first workpiece 184 to a fixed workpiece 186. FIG. 8B is a cross section of the dashed box indicated in FIG. 8A. As can be seen FIGS. 8A and 8B, the fixed workpiece 186 can be secured to the tabletop 32 in the conventional manner by any means known to the Artisan. The second arm 16 of the clamp 10 is disposed in a slot 30 in the tabletop 32. A swivel 190 of the swivel clamp head 24 is shown as a circle having an origin 192 centered on a vertical reference line 194. A reference radius 196 is drawn from the origin 192 to the first corner 138. When installed, the vertical reference line 194 may coincide with a first indicator line 198.

Figure 9B:
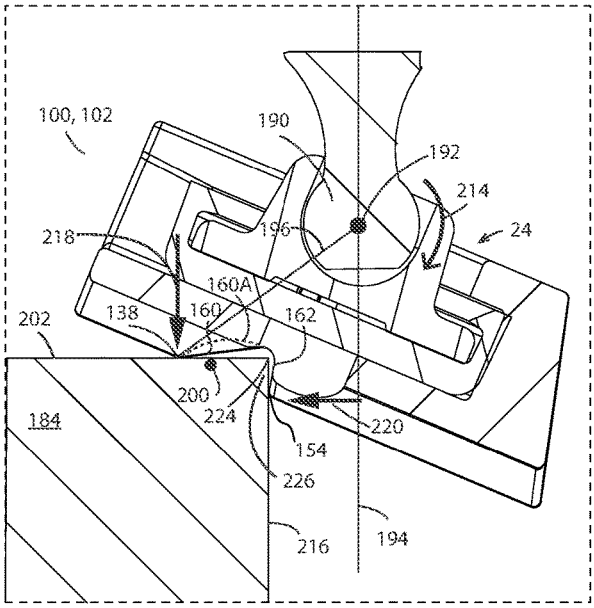
FIG. 9B is a cross section of the dashed box indicated in FIG. 9A.

In FIGS. 8A, 8B, 9A, and 9B the clamp 10 is considered perfectly rigid with no slack between the components for sake of illustrating the principle of operation. FIGS. 10A and 10B illustrate the principle of operation with real world considerations of flex and slack between the components. As shown in FIGS. 8A and 8B, immediately prior to contacting the first workpiece 184, the first corner 138 is immediately above an initial contact point 200 on an upper surface 202 of the first workpiece 184. A gap 204 exists between the first workpiece 184 and the fixed workpiece 186. The vertex 130 of the groove 110 is indicated by a second indicator line 206. Gap 204 is shown with an exaggerated dimension. Typically, the gap 204 will be minimal. There may even be no gap 204.

Figure 9A:
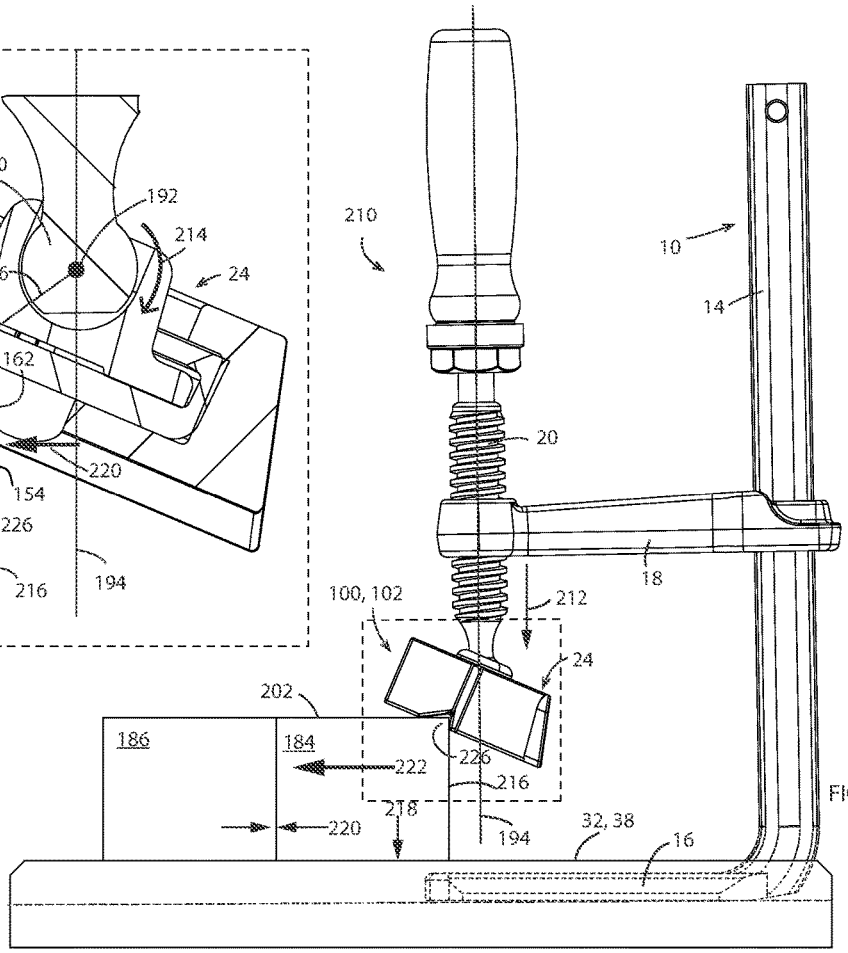
FIG. 9A is a schematic illustration of the clamp head adapter on the F-type clamp in a first clamping configuration.
Figure 10B:
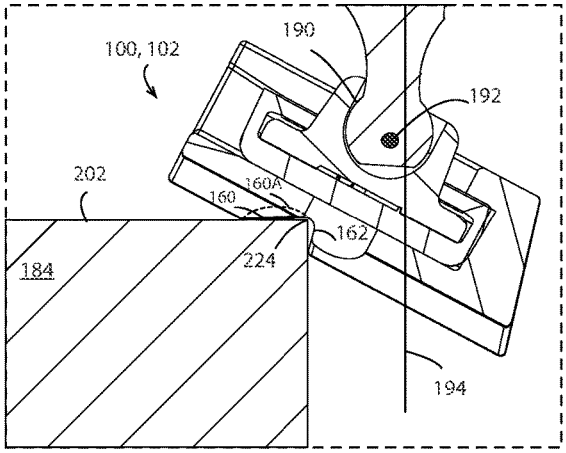
FIG. 10B is a cross section of the dashed box indicated in FIG. 10A.
Figure 10A:
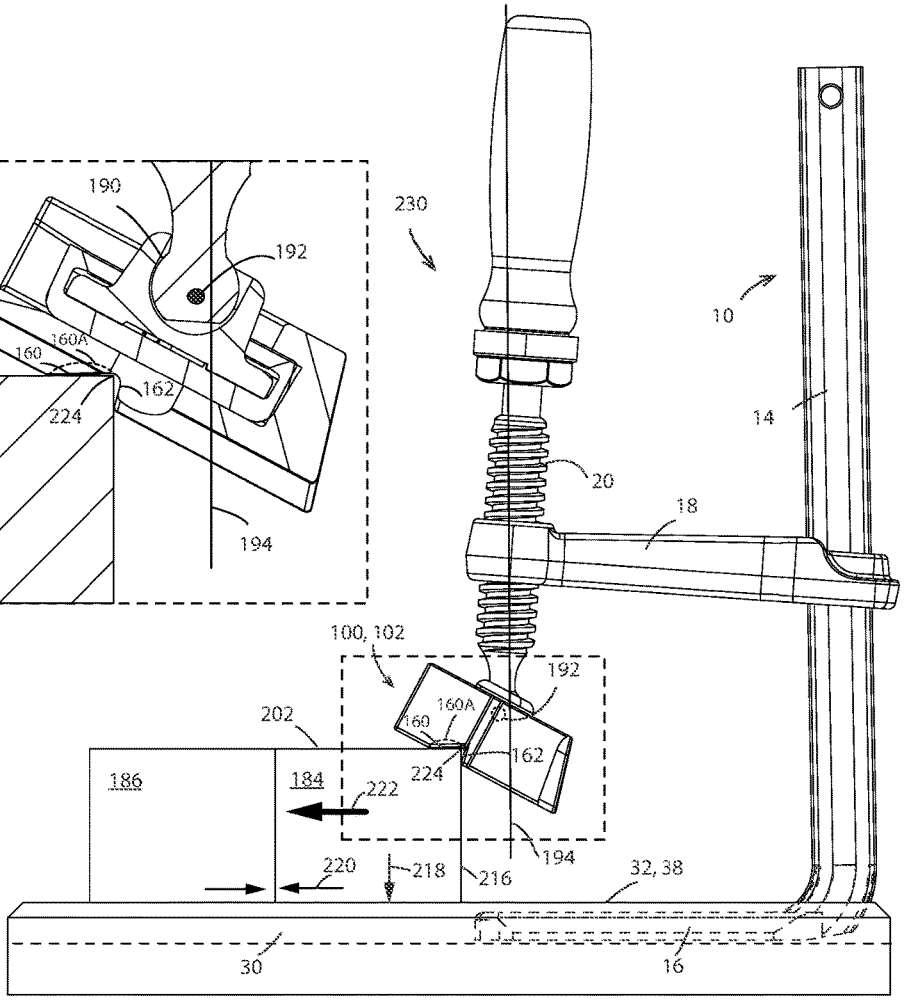
FIG. 10A shows the arrangement of FIG. 9 with the F-type clamp in a second clamping configuration.

FIG. 9A is a schematic illustration of the clamp head adapter 100 on the F-type clamp 10 in a first clamping configuration 210. FIG. 9B is a cross section of the dashed box indicated in FIG. 9A. As can be seen in FIGS. 9A and 9B, in the first clamping configuration 210, the threaded shaft 20 and the swivel clamp head 24 with its associated swivel 190 have moved in a downward direction 212 along the vertical reference line 194. Once the first corner 138 contacted the initial contact point 200 on the upper surface 202 of the first workpiece 184, the first corner 138 was prevented from farther downward movement. The swivel 190 rotated in a direction of rotation 214 as a result. Since a length of the reference radius 196 remains the same, since the origin remains on the vertical reference line 194 in this example, and since the first workpiece 184 does not move until the second corner 154 contacts the side surface 216, the first corner initially slides to the left along the upper surface 202 of the first workpiece 184 as the swivel clamp head 24 is farther lowered. The vertical reference line 194 will be laterally outside the first workpiece 184 to enable this rotation of the swivel clamp head 24. During this time, the second corner 154 moves to the left toward a side surface 216 of the first workpiece 184. Upon sufficient leftward movement, the second corner 154 contacts the side surface 216 of the first workpiece 184 and begins to move the first workpiece 184 in a lateral direction 222 toward the fixed workpiece 186 until the first workpiece 184 abuts the fixed workpiece 186.

Once the second corner 154 contacts the side surface 216, the second corner continues to move downward along the side surface 216 as the first workpiece 184 moves to the left. When the second corner 154 moves downward along the side surface 216 as the first workpiece 184 moves, the first corner 138 begins to move back toward the initial contact point 200. Where the first corner 138 comes to rest depends on when the first workpiece 184 contacts the fixed workpiece 186, at which time the configuration becomes interlocked in place. For example, if the gap 204 is very small and the first workpiece 184 abuts the fixed workpiece 186 right away, the first corner 138 may not travel as for to the right as it traveled to the left. In this instance, the first corner 138 will be to the left of the initial contact point 200 as is shown in FIG. 9B. If the gap 204 is relatively larger, the first corner 138 may travel farther to the right than it traveled to the left. In this instance, the first corner 138 will be to the right of the initial contact point 200 (not shown). It is also possible that the first corner 138 travels back to and comes to rest over the initial contact point 200.

This results in the first clamping configuration 210 shown in FIGS. 9A and 9B. As can be seen, the gap 204 present in FIG. 8A is no longer present in FIG. 9A. A normal clamping force 218 is established and a lateral clamping force 220 is established as the clamp head adapter 100 is lowered/tightened. In embodiments where there is no gap 204 initially, the lateral movement of the first workpiece 184 will be dispensed with prior to the application of the lateral clamping force 220.

The first side 160 of the groove 110 may become flush with the upper surface 202 of the first workpiece 184 at the moment the first workpiece 184 abuts the fixed workpiece 186. In such a scenario, further lowering of the swivel clamp head 24 may be unnecessary and/or detrimental in that further lowering could over rotate the clamp head adapter 100 and perhaps damage an apex 224 of a top right corner region 226 of the first workpiece 184, or even damage more of the corner region 226. However, in this scenario the normal clamping force 218 and the lateral clamping force 220 will be minimal.

Alternately, the first side 160 of the groove 110 may not yet be flush with the upper surface 202 of the first workpiece 184 at the moment the first workpiece 184 abuts the fixed workpiece 186, or the first side is concave as shown by dashed line 160A. If the swivel clamp head 24 is lowered farther, (optionally until the first side 160 rests flush atop the upper surfaced 202), the second corner 154 will want to continue moving to the left due to the rotation of the swivel 190. In an embodiment suitable for soft materials such as wood, the second corner 154 may yield to the unmoving side surface 216 to avoid damaging the side surface 216. Accordingly, in an embodiment, at least one of the second corner 154, a region around the second corner 154, and the entire clamp head adapter 100 is made of the resilient material such as plastic or rubber etc. In FIG. 9A, the second corner 154 is shown as compressed to illustrate the principle. In this alternate scenario, the resilience of the second corner 154 permits additional lowering of the swivel clamp head 24 after the first workpiece 184 contacts the fixed workpiece 186. This, in turn, increases a magnitude of both the normal clamping force 218 and the lateral clamping force 220. Hence, the clamp head adapter 100 enables a single, linear clamp 10 to provide both the conventional normal clamping force 218 and the desirable lateral clamping force 220. This represents an improvement in the art.

Alternately, for applications where damage is less of a concern, such as if the workpiece is composed of a metal or the like, the clamp head adapter 100 may not be composed of a resilient material. In such embodiments, the clamp head adapter 100 may be composed of a rigid material such as a metal or the like.

Accordingly, the clamp head adapter 100 may stop rotating for one of several reasons. In a first instance, the clamp head adapter 100 stops rotating when the first side 160 comes to rest flush on the upper surface 202 of the first workpiece 184. The clamp head adapter 100 may stop rotating before this if the second corner 154 can no longer yield. Depending on the swivel clamp head 24 selected, the clamp head adapter 100 may stop rotating when the swivel clamp head 24 reaches its maximum swivel angle.

The above illustrates an advantage of the asymmetry of the groove 110. By way of comparison, a conventional groove may include a symmetric groove where each bevel angle is the same, for example, forty-five (45) degrees. This yields a groove with a groove angle of ninety (90) degrees. The first side and the second side of such a groove are perpendicular to each other. As can be seen in FIG. 9A, if the second side 162 of the groove 110 were perpendicular to the first side 160 of the groove 110, then the second corner 154 would not contact the side surface 216 of the first workpiece 184 until the first side 160 is already flat on the upper surface 202. Hence, there would be no movement of the first workpiece 184 in the lateral direction 222 before the first side 160 rests flat on the upper surface 202. Further lowering of the swivel clamp head 24 would over rotate the clamp head adapter 100. This would raise the first corner 138 off the upper surface 202 of the first workpiece 184 and move the downward clamping force toward the apex 224 of the corner region 226. The relocated clamping force might damage the apex 224 and/or reduce the effectiveness of the normal clamping force 218.

Stated another way, in the embodiments disclosed above the groove angle 156 is acute because if the first side 160 and the second side 162 are straight, then any groove angle of ninety (90) degrees or more will result in the corner region 226 contacting the first side 160 or the second side 162 before sufficient rotation takes place to create the lateral clamping force 220. As the clamp head adapter 100 is lowered onto the first workpiece 184, the corner region 226 would simply nest into the groove 110. In such an instance, the second corner 154 would not contact the second side 216 until the first side 160 came to rest flush on the upper surface 202. Hence, there would be no lateral movement of the second corner 154 nor any associated lateral clamping force 220.

An asymmetric groove angle was chosen to create a desired leverage and associated lateral clamping force 220. However, the groove angles need not be asymmetric to create the lateral clamping force 220. Moreover, the lateral clamping force 220 can also be created using a nonlinear groove surface.

In a broad sense, the groove 110 must at a minimum be configured to receive the ninety (90) degree corner region 226 of the first workpiece 184 when the first corner 138 and the second corner 154 contact the first workpiece 184 while the groove sides 160, 162 are set apart from the corner region 226 of the first workpiece 184 that is received/disposed in the groove 110. So long as the groove sides 160, 162 are set apart from the corner region 226 to some degree, the first corner 138 and the second corner 154 can slide along the upper surface 202 and the side surface 216 respectively due to the above-described rotation of the clamp head adapter 100 without geometric interference between the corner region 226 and the groove 110. This, in turn, enables the establishment of the lateral clamping force 220 under the principles disclosed above. This set-apart spacing between the corner region 226 and the first side 160 and the second side 162 is most visible in FIG. 9B. After enough rotation the corner region 226 may eventually abut the first side 160 or the second side 162, but by then the lateral clamping force 220 may be established.

Figure 9C:
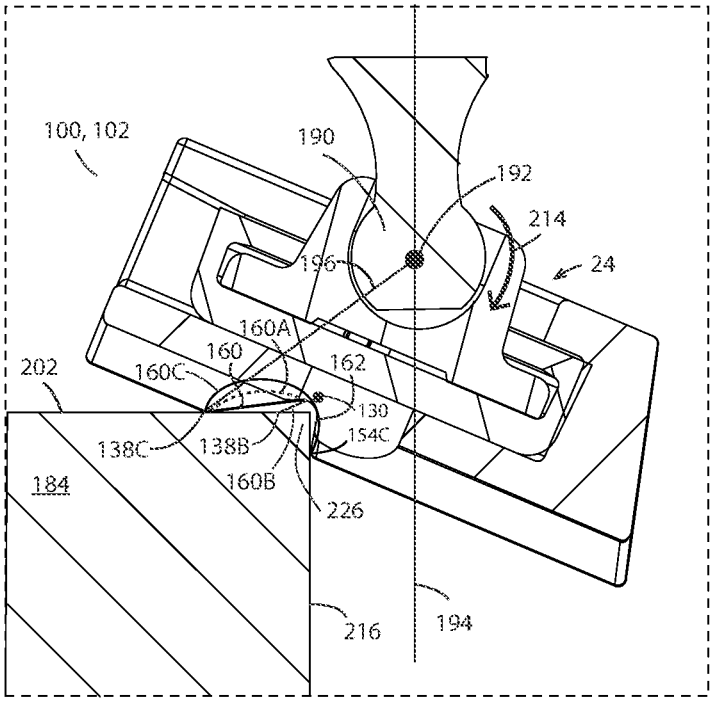
FIG. 9C shows various embodiments of the clamp head adapter in the cross section of FIG. 9B.

FIG. 9C shows various alternate embodiments of the clamp head adapter in the cross section of FIG. 9B. In one alternate embodiment, the first side 160B and the second side 162 may be straight and the first bevel angle 132 and the second bevel angle 150 are equal to each other. In other words, the groove angle and is acute and symmetric, as opposed to the disclosure above. The symmetric, acute groove angle configuration of FIG. 9C results in a shorter length of the first side 160B between the first corner 138B and the vertex 130 when compared to a configuration where the first bevel angle 132 is larger than the second bevel angle 150 (e.g. FIG. 9A). Shortening the length of the first side 160B between the first corner 138B and the vertex 130 may reduce the leverage and associated lateral clamping force 220. However, the established lateral clamping force 220 may be sufficient.

Since sometimes a larger lateral clamping force 220 is desired, a first bevel angle 132 that is larger than the second bevel angle 150 is selected (e.g. an asymmetric groove angle 156) as disclosed in FIGS. 8A, 8B, 9A, and 9B. This results in the length of the first side 160B between the first corner 138B and the vertex 130 being greater than a length of the second side 162 between the second corner 154 and the vertex 130. This, in turn, results in more leverage and a greater associated lateral clamping force 220. Having greater leverage and associated lateral clamping force is a reason for selecting a groove angle 156 that is asymmetric, namely where the first bevel angle 132 is greater than the second bevel angle 150 as disclosed in FIGS. 8A, 8B, 9A, and 9B.

In the alternate embodiment disclosed above, the first side 160A may be arcuate to enable more rotation and associated lateral clamping force 220.

In another alternate embodiment, there may not be a distinct first side and second side. Instead, a groove surface 160C may comprise any continuous or segmented shape that permits the disclosed rotation. An example groove surface 160C is arcuate and terminates on one end at the first corner 138C and at the other end at second corner 154C. The groove 110 can clearly receive the 90 degree corner region 226 of the first workpiece 184 while the first corner 138C and the second corner 154C move along the upper surface 202 and the side surface 216 through a wide range of positions. Any shape of the groove surface 160C between the first corner 138C and the second corner 154C that permits this movement is permissible and within the intended scope of this disclosure.

In addition, for embodiments of the clamp head adapter 100 with a straight first side 160 and a straight second side 162, an acute angle (e.g. less than ninety (90) degrees) is necessary because the first workpiece 184 has a ninety (90) degree corner region 226. If the workpiece has a corner region with a different angle, a different groove angle could be used. For example, if the workpiece corner region was one hundred twenty (120) degrees and the first side 160 and the second side 162 are straight, then the groove angle could be any angle less than one hundred twenty (120) degrees. The reason for this is the same reason an acute groove angle 156 is selected for a workpiece with a ninety (90) degree corner region 226. So long as the groove angle is less than the angle of the corner region of the workpiece, the lateral clamping force will be established. Making the groove angle asymmetric will simple increase the leverage and lateral clamping force. Symmetric ninety (90) degree and greater grooves are known in the art. However, the asymmetric ninety (90) degree and greater grooves disclosed herein appear to represent an improvement in the art.

FIG. 10A is a schematic illustration of the clamp head adapter 100 on the F-type clamp 10 in a second clamping configuration 230. FIG. 10B is a cross section of the dashed box indicated in FIG. 10A. Prior to reaching the second clamping configuration 230, the clamp 10 is initially positioned (before clamping) slightly laterally closer to the fixed workpiece 186. The vertical reference line established by the first clamping configuration 210 in FIG. 9A is also present in FIGS. 10A and 10B. In this laterally closer position, the origin 192 of the swivel 190 is slightly to the left of the vertical reference line 194. The threaded shaft 20 is lowered to clamp the clamp head adapter 100 onto the first workpiece 184. In this illustrative example, any or all of the first arm 14, the second arm 16, and the guide arm 18 may flex in reaction to clamping forces, and there may be slack in the joints of the arms. The swivel clamp head 24 is lowered as described in the discussion related to FIGS. 8A, 8B, 9A, and 9B. The same principles also apply and the first workpiece 184 is moved to the left and the normal clamping force 218 and the lateral clamping force 220 are created. Between the time the clamp head adapter 100 first contacts the upper surface 202 of the first workpiece 184 and the second clamping configuration 230 shown, the clamp 10 reacts to the clamping forces. The reaction flexes the arms and takes up the slack in the joints to produce the second clamping configuration 230. The embodiment of the second clamping configuration 230 shown in FIGS. 10A and 10B are not meant to reflect actual relative angles and positions possible, but merely to illustrate the general concept. For example, in a variation, the second side 160 may rest flush atop the upper surface 202.

As before, the second clamping configuration 230 generates a normal clamping force 218 and a lateral clamping force 220. However, by virtue of the flex and slack in the clamp 10, the lateral clamping force 220 may be greater. This is because the clamp is now angled relative to the vertical reference line 194 such that the force it creates has a horizontal (e.g. lateral) component not present when the clamp is aligned with the vertical reference line 194. Moreover, the flex of the clamp also contributes to the lateral clamping force 220. The amount of lateral clamping force 220 that can be generated thereby depends on several factors, including (but not limited to) the initial relative position of the clamp 10 to the workpiece, the mechanical characteristics of the clamp 10, the amount the swivel clamp head 24 is lowered onto the first workpiece 184, the values selected for the first bevel angle 132 and second bevel angle 150, and a resilience of the material selected for the clamp head adapter 100.

The above examples of how the clamp head adapter 100 and the first workpiece 186 are initially positioned are not meant to be limiting. The clamp may be positioned in a variety of locations and the clamp head adapter 100 may likewise be initially positioned in a variety of ways relative to the first workpiece 184. For example, the clamp head adapter 100 may be initially positioned such that the first corner 138 and the second corner 154 are in contact with the first workpiece 184 before the clamp is tightened. Further, the first workpiece 184 may or may not initially abut the fixed workpiece 186.

Figure 11:
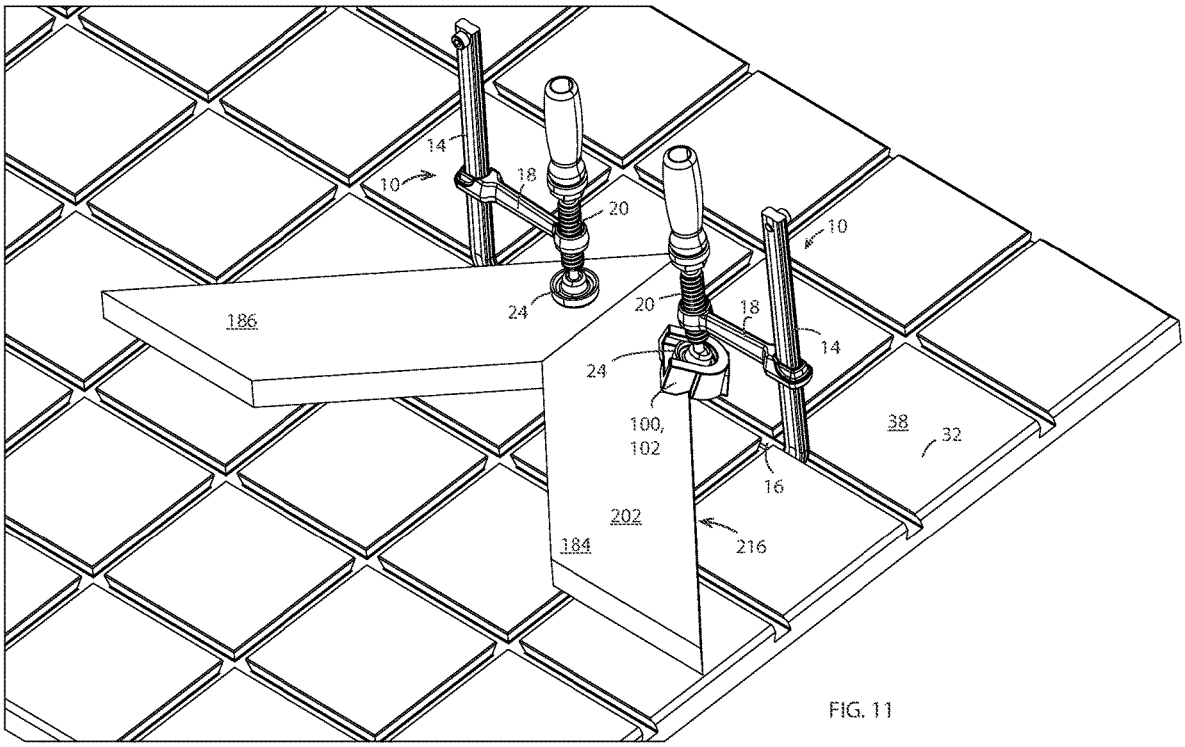
FIG. 11 shows the clamp head adapter on an F-type clamp and securing two workpieces to form a mitered corner.

FIG. 11 shows the clamp head adapter 100 on an F-type clamp and securing the first workpiece 184 to the fixed workpiece 186 to form a mitered corner. The fixed workpiece 186 is secured using a conventional/normal clamping force. The first workpiece is secured using the clamp head adapter 100 and is thereby laterally clamped to the fixed workpiece 186. The clamp head adapter 100 makes it possible to secure the mitered corner using as few as two clamps 10, whereas prior art techniques may require several clamps.

Figure 12:
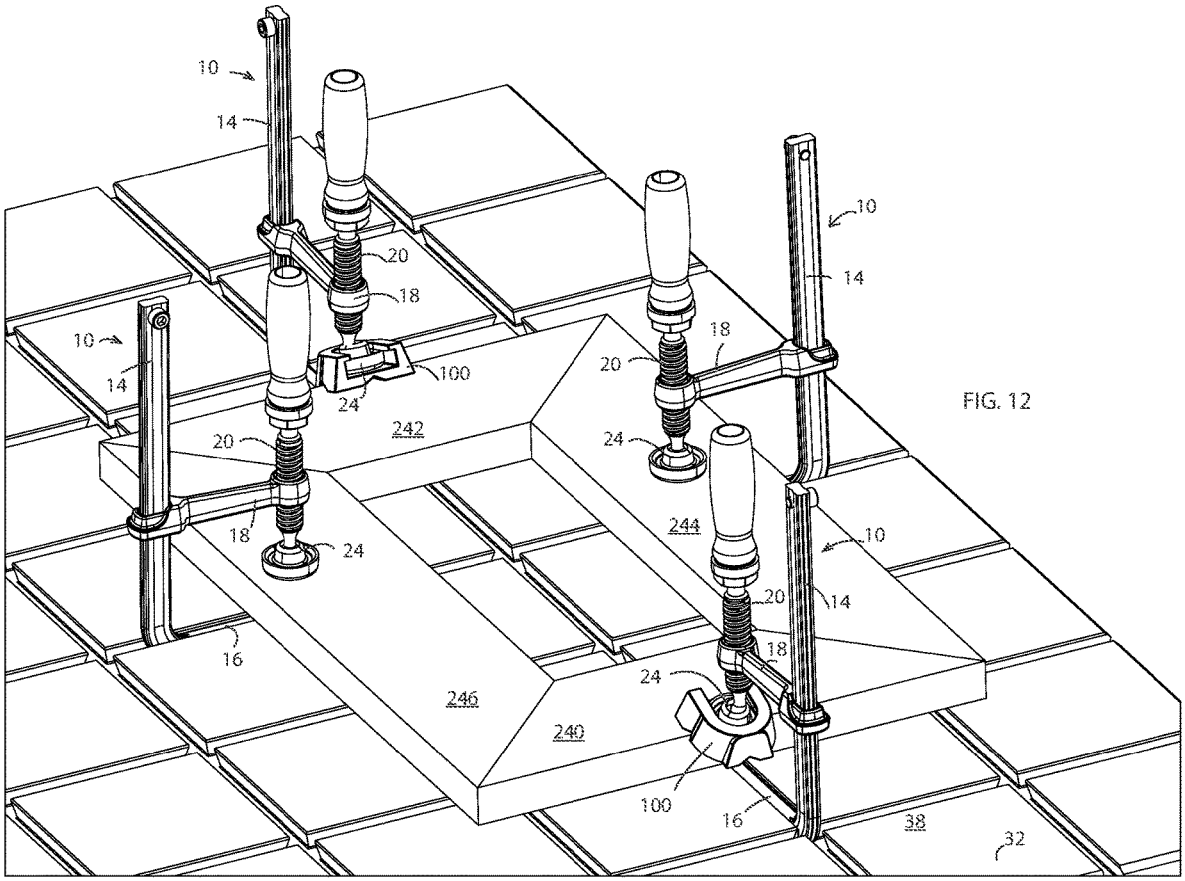
FIG. 12 shows the clamp head adapter on two F-type clamps and securing four workpieces to form an entire frame.

FIG. 12 shows four F-type clamps clamping workpieces 240, 242, 244, 246. Workpieces 244 and 246 are clamped to the tabletop 32 using respective F-type clamps without the clamp head adapter 100. Hence, workpieces 244 and 246 are secured using conventional/normal clamping force. Workpieces 240 and 242 are secured to the tabletop 32 using respective F-type clamps with the clamp head adapter 100. Hence, workpieces 240 and 242 are also laterally clamped to the workpieces 244 and 246. This simple arrangement provides sufficient normal and lateral clamping force for a frame with merely four clamps while leaving the center area accessible, representing an improvement over the prior art arrangements.

Figure 13:
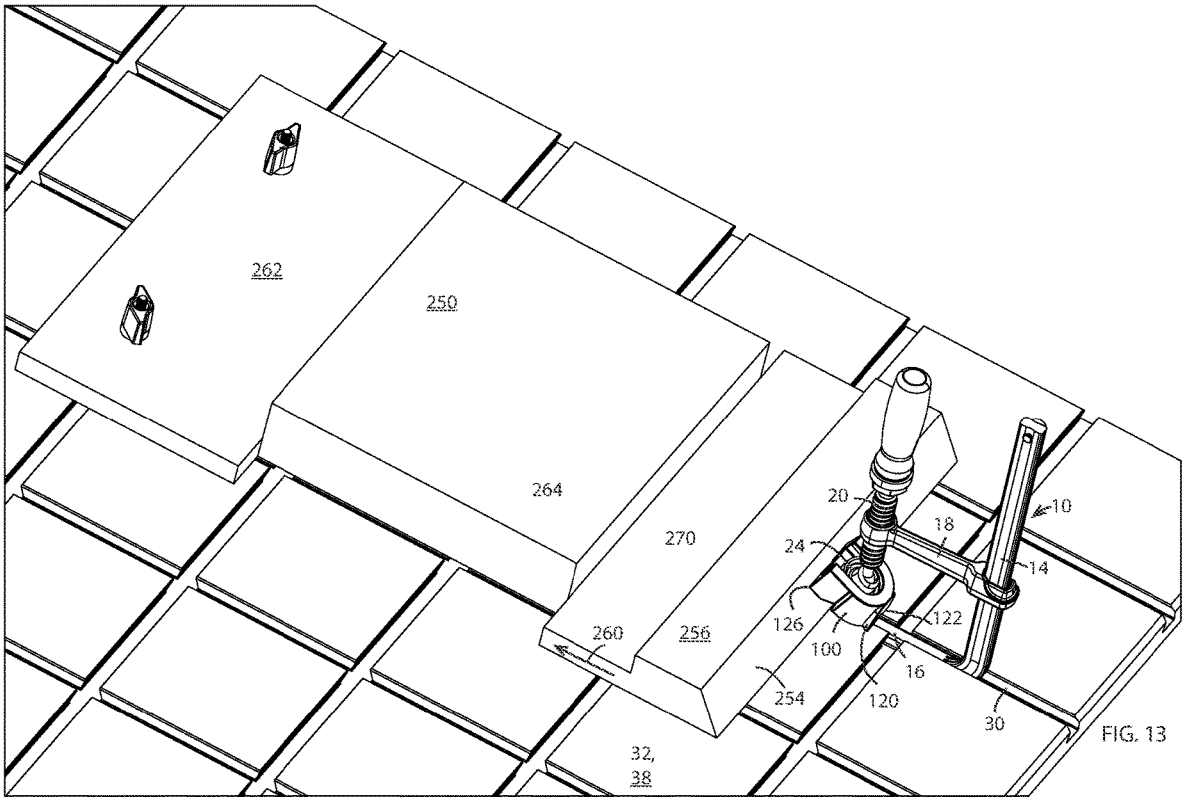
FIG. 13 shows the clamp head adapter securing a workpiece in an alternate configurations.

FIG. 13 shows an F-type clamp with a clamp head adapter 100 securing a workpiece 250 in an alternate configuration that leaves the top of the workpiece 250 unobstructed. The straight pad edge 122 of the pad 120 is placed directly on the surface 38 of the tabletop 32. The straight pad edge 122 may be required to span a slot 30, so in an embodiment its length is sufficient to do so. The straight corner edge 126 is positioned on an inclined surface 254 of an adapter 256 that abuts the workpiece 250. Tightening the clamp causes the straight corner edge 126 to apply normal/conventional clamping force as well as lateral clamping force on the inclined surface 254 of the adapter 256. The adapter 256 transfers a resulting lateral clamping force 260 to the workpiece 250, thereby laterally clamping the workpiece 250 between the adapter 256 and a fixture 262. This leaves a top 264 of the workpiece 250 accessible for woodworking operations. In the embodiment shown, the adapter 256 includes an area 270 that is lower than the top 250 of the workpiece 250 when clamped. This permits woodworking operations such as sanding of the top 264 without having to accommodate the presence of a clamp on the top 264. Alternately, the adapter 256 need not have an inclined surface 254. Instead, the straight corner edge 126 could be applied to a vertical surface of the adapter 256 and friction therebetween could provide the conventional/normal clamping force while the lateral clamping force is applied. Moreover, the adapter 256 is not required. The straight corner edge 126 could be applied directly to a side surface of the workpiece 250.

The above-described principles are understood to apply but are not intended to limit the principles under which the clamp head adapter may be used.

As disclosed above, the Inventor has devised an innovative yet simple clamp head adapter that can be used to simplify how workpieces can be secured together. This can save time and effort and thereby reduce costs associated with securing the workpieces. Consequently, the clamp head adapter represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An apparatus, comprising:

an adapter body;

a slot disposed on a first side of the adapter body, wherein the adapter body is configured to be moved parallel to a face of a disk-shaped clamp head to receive the disk-shaped clamp head in the slot, and wherein the slot comprises a channel configured to receive and sandwich therein a perimeter of the disk-shaped clamp head;

an asymmetric groove recessed into a body surface of the adapter body opposite the first side; the groove comprising a vertex, a first bevel angle between a normal line normal to the body surface and a first line between the vertex and a first corner of the groove disposed at the body surface, and a second bevel angle between the normal line and a second line between the vertex and a second corner of the groove disposed at the body surface;

wherein the first bevel angle and the second bevel angle together form a groove angle that is less than 90 degrees; and wherein the first bevel angle and the second bevel angle are not equal to each other.

2. The apparatus of claim 1, wherein the adapter body comprises a resilient material.

3. The apparatus of claim 1, wherein a first side of the groove extends between the vertex and the first corner and is straight.

4. The apparatus of claim 1, wherein the first bevel angle is 60 degrees.

5. The apparatus of claim 1, wherein a second side of the groove directly connects the vertex to the second corner and is straight.

6. The apparatus of claim 1, wherein a second side of the groove extends between the vertex and the second corner and is concave.

7. The apparatus of claim 1, further comprising a second groove in the body surface disposed transverse to the groove, wherein the second groove is symmetric about the normal line.

8. The apparatus of claim 1, wherein the adapter body comprises a rubber material or a plastic material.

9. The apparatus of claim 1, further comprising an F-type clamp comprising the clamp head disposed on a swivel mount.

10. An apparatus, comprising:

an adapter body comprising: a first side configured to receive a clamp head of a clamp; and a second side opposite the first side and comprising a second surface;

an asymmetric groove disposed in the second surface, comprising a groove angle comprising: a vertex disposed along a normal line normal to the second surface; a first bevel angle between the normal line and a first corner of the groove at the second surface; and a second bevel angle between the normal line and a second corner of the groove at the second surface, wherein the first bevel angle and the second bevel angle are not equal to each other; and a second groove in the second surface disposed transverse to the groove, wherein the second groove comprises symmetric bevel angles.

11. The apparatus of claim 10, wherein the groove angle is less than ninety (90) degrees.

12. The apparatus of claim 10, wherein the first bevel angle is sixty (60) degrees and the second bevel angle is less than thirty (30) degrees.

13. The apparatus of claim 10, wherein the groove comprises a first side that forms the first bevel angle and a second side that forms the second bevel angle, and wherein the first side comprises a straight portion.

14. The apparatus of claim 13, wherein the second side comprises a straight portion.

15. The apparatus of claim 10, wherein the second groove comprise a second groove angle of 120 degrees.

16. The apparatus of claim 10, wherein the second groove is disposed perpendicular to the groove.

17. The apparatus of claim 10, wherein the adapter body further comprises a first straight edge in the second side and a second straight edge in the second side, wherein the first straight edge and the second straight edge are parallel to each other and are on opposite ends of the adapter body.

18. An apparatus, comprising:

an adapter body comprising: a first side configured to receive a clamp head of a clamp; and a second side opposite the first side and comprising a second surface;

an asymmetrically shaped groove disposed in the second surface, comprising a groove surface that extends between a first corner of the groove at the second surface and a second corner of the groove at the second surface; and a second groove in the second surface disposed transverse to the groove, wherein the second groove comprises symmetric bevel angles, wherein the asymmetrically shaped groove is configured to receive a 90 degree corner region of a workpiece when the first corner and the second corner contact the workpiece while the groove surface is set apart from the corner region of the workpiece received in the groove;

wherein the groove surface comprises a first side that comprises a first straight portion between the first corner and a vertex, wherein the groove surface comprises a second side that comprises a second straight portion between the second corner and the vertex, and wherein a groove angle formed between the first straight portion and the second straight portion is acute; and wherein a first distance between the first corner and the vertex is greater than a second distance between the second corner and the vertex.

19. The apparatus of claim 18, wherein the groove surface comprises an arcuate shape.

20. The apparatus of claim 19, wherein the arcuate shape terminates at the first corner.

21. The apparatus of claim 20, wherein the arcuate shape terminates at the second corner.

* * * * *